US008663814B2

(12) United States Patent
Eichmann et al.

(10) Patent No.: US 8,663,814 B2
(45) Date of Patent: Mar. 4, 2014

(54) ANTI-WEAR COATING AND COMPONENT COMPRISING AN ANTI-WEAR COATING

(75) Inventors: Wolfgang Eichmann, Puchheim (DE); Falko Heutling, Munich (DE); Thomas Uihlein, Dachau (DE)

(73) Assignee: MTU Aero Engines GmbH, Munich (DE)

( * ) Notice: Subject to any disclaimer, the term of this patent is extended or adjusted under 35 U.S.C. 154(b) by 340 days.

(21) Appl. No.: 12/664,372

(22) PCT Filed: May 17, 2008

(86) PCT No.: PCT/DE2008/000841

§ 371 (c)(1),
(2), (4) Date: May 28, 2010

(87) PCT Pub. No.: WO2008/154890

PCT Pub. Date: Dec. 24, 2008

(65) Prior Publication Data

US 2012/0141822 A1 Jun. 7, 2012

(30) Foreign Application Priority Data

Jun. 14, 2007 (DE) ..... 10 2007 027 335

(51) Int. Cl.
*B32B 15/04* (2006.01)

(52) U.S. Cl.
USPC ..... 428/623; 428/621; 428/472; 428/432; 428/457

(58) Field of Classification Search
None
See application file for complete search history.

(56) References Cited

U.S. PATENT DOCUMENTS

| | | | | |
|---|---|---|---|---|
| 5,223,350 | A * | 6/1993 | Kobayashi et al. | 428/697 |
| 5,499,905 | A | 3/1996 | Schmitz et al. | |
| 6,087,730 | A * | 7/2000 | McGarvey et al. | 257/766 |
| 6,410,411 | B1 * | 6/2002 | McGarvey et al. | 438/592 |
| 6,696,171 | B2 * | 2/2004 | Sartwell et al. | 428/610 |
| 7,621,648 | B2 * | 11/2009 | Wuillaume et al. | 359/883 |
| 2005/0136656 | A1 * | 6/2005 | Zeng et al. | 438/680 |
| 2007/0026324 | A1 * | 2/2007 | Yoshida et al. | 430/7 |
| 2007/0098993 | A1 * | 5/2007 | Chen | 428/408 |
| 2007/0111003 | A1 * | 5/2007 | Chen | 428/408 |
| 2007/0116956 | A1 * | 5/2007 | Chen | 428/408 |

(Continued)

FOREIGN PATENT DOCUMENTS

| | | | |
|---|---|---|---|
| DE | 10 2004 001 392 | A1 | 8/2005 |
| DE | 10 2004 032 403 | B3 | 12/2005 |

(Continued)

OTHER PUBLICATIONS

Merriam Webster's Collegiate Dictionary, 1996, p. 31.*

(Continued)

*Primary Examiner* — Vera Katz
(74) *Attorney, Agent, or Firm* — Crowell & Moring LLP

(57) ABSTRACT

An anti-wear coating, in particular an anti-erosion coating, which is applied to a surface of a component that is stressed under fluid technology and is to be protected, in particular a gas turbine part, is disclosed. The anti-wear coating includes one or more multilayer systems applied in a repeating order to the surface to be coated, and the/each multilayer system includes at least one relatively soft metallic layer and at least one relatively hard ceramic layer. All the layers of the/each multilayer system are based on chromium, and a diffusion barrier layer is applied between the surface to be protected and the multilayer system(s).

10 Claims, 1 Drawing Sheet

(56) References Cited

U.S. PATENT DOCUMENTS

| | | | | |
|---|---|---|---|---|
| 2007/0190351 | A1 | 8/2007 | Eichmann et al. | |
| 2007/0291381 | A1* | 12/2007 | Wuillaume et al. | 359/838 |
| 2008/0095939 | A1* | 4/2008 | Fischer et al. | 427/255.394 |
| 2008/0261073 | A1* | 10/2008 | Maloney et al. | 428/680 |
| 2009/0120241 | A1* | 5/2009 | Vetter | 76/115 |
| 2009/0180725 | A1* | 7/2009 | Galehouse et al. | 384/492 |
| 2009/0324937 | A1* | 12/2009 | Lev et al. | 428/336 |

FOREIGN PATENT DOCUMENTS

| | | | |
|---|---|---|---|
| EP | 0 366 289 | A1 | 5/1990 |
| EP | 0 562 108 | B1 | 9/1993 |
| EP | 0 674 020 | B1 | 9/1995 |
| WO | WO 2005/066384 | A1 | 7/2005 |
| WO | WO 2006/005217 | A2 | 1/2006 |
| WO | WO 2006/084404 | A1 | 8/2006 |

OTHER PUBLICATIONS

Vetter, J., et al., "(Cr:AI)N coatings deposited by the cathodic vacuum arc evaporation", Surface and Coatings Technology, Bd. 98, Nr. 1-3, pp. 1233-1239, Jan. 1998, Amsterdam, XP002347451.

PCT/DE2008/000841 PCT/ISA/210.

Office Action, w/Translation, dated Feb. 22, 2011, 11 pages.

* cited by examiner

ANTI-WEAR COATING AND COMPONENT COMPRISING AN ANTI-WEAR COATING

BACKGROUND AND SUMMARY OF THE INVENTION

This application claims the priority of International Application No. PCT/DE2008/000841, filed May 17, 2008, and German Patent Document No. 10 2007 027 335.7, filed Jun. 14, 2007, the disclosures of which are expressly incorporated by reference herein.

The invention relates to an anti-wear coating, in particular an anti-erosion coating, preferably for gas turbine components. The invention also relates to a component having such an anti-wear coating.

Components such as gas turbine components which are exposed to stresses in flow technology are subject to wear due to oxidation, corrosion and erosion. Erosion is a wear process induced by solid particles entrained in the gas flow. To prolong the lifetime of components used in flow technology, anti-wear coatings that protect the components from wear, in particular from erosion, corrosion and oxidation, are required.

European Patent Document No. EP0674020B1 describes a multilayer erosion-resistant coating for the surfaces of substrates. The erosion-resistant coating disclosed there is an anti-wear coating comprising several multilayer systems applied in a repeating order to the substrate to be coated. In EP0674020B1 the multilayer systems applied in a repeating order are thus formed from two different layers, namely first a layer of a metallic material and secondly a layer of titanium diboride. With the anti-erosion coating according to EP0674020B1, the multilayer systems applied in a repeating order are formed from only two layers, so with the anti-erosion coating disclosed there, alternating layers of metallic material and layers of titanium diboride are provided.

European Patent Document No. EP0366289A1 discloses another erosion-resistant and corrosion-resistant coating for a substrate. According to EP0366289A1, the anti-wear coating is also formed from several multilayer systems applied in a repeating order to the substrate to be coated, each multilayer system in turn comprising two different layers, namely a metallic layer, e.g., titanium, and a ceramic layer, e.g., titanium nitride.

Another erosion-resistant anti-wear coating is known from European Patent Document No. EP0562108B1. The anti-wear coating disclosed there is in turn formed from several multilayer systems applied in a repeating order to a substrate to be coated. FIG. 4 of EP0562108B1 discloses an anti-wear coating formed from several multilayer systems applied in a repeating order, each multilayer system comprising four layers, namely a ductile layer of tungsten or a tungsten alloy and three hard layers, such that the three hard layers differ with regard to an additional element content.

Against this background, the present invention is based on the problem of creating a novel anti-wear coating and a component comprising such an anti-wear coating.

According to the invention, all the layers of the/each multilayer system are based on chromium, with a diffusion barrier layer being applied between the surface to be protected and the multilayer system(s).

The inventive anti-wear coating ensures a very good erosion resistance and oxidation resistance. The inventive anti-wear coating has an extremely low influence on the vibration resistance of the coated component. Due to the fact that a diffusion barrier layer is integrated between the component surface and the multilayer system(s), the inventive anti-wear coating has a high thermodynamic stability. The inventive anti-wear coating may be used over a longer period of time at very high temperatures.

The diffusion barrier layer preferably has a mono-nanostructured design and is embodied as a CrN layer in particular.

Preferred further embodiments of the invention are derived from the following description. Exemplary embodiments of the invention are explained in greater detail on the basis of the drawings, although the invention is not limited thereto.

DETAILED DESCRIPTION OF THE DRAWINGS

The invention provided here relates to an anti-wear coating for a component, in particular for a gas turbine component, such as a gas turbine blade. It is possible to coat the entire component with the anti-wear coating. It is also possible to coat only selected sections and/or areas of the component with the inventive anti-wear coating.

Figure 1:
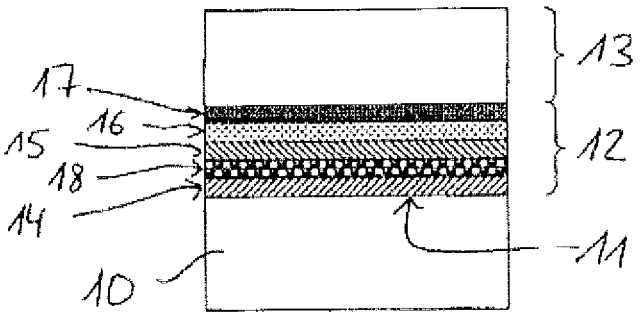
FIG. 1 shows a highly schematic cross section through an inventive anti-wear coating according to a first exemplary embodiment of the invention.

FIG. 1 shows a highly schematized cross section through a coated component 10, with an inventive anti-wear coating applied to the surface 11 of the component 10. According to FIG. 1, the anti-wear coating comprises two multilayer systems 12 and 13. Each of the multilayer systems 12, 13 comprises multiple layers.

Thus in the exemplary embodiment according to FIG. 1, each multilayer system 12, 13 comprises a layer 14 of a metallic material, a layer 15 of a metal alloy material, a layer 16 of a graded metal-ceramic material and a layer 17 of a ceramic material. In addition, a mono-nanostructured diffusion barrier layer 18 is provided between the multilayer system 12 and the surface 11 of the component 10. The mono-nanostructured diffusion barrier layer is formed here as a ceramic CrN layer based on chromium.

The component 10 is preferably formed from a nickel-based alloy, a cobalt-based alloy, an iron-based alloy or a titanium-based alloy. Each layer 14, 15, 16, 17 of each multilayer system 12, 13 of the inventive anti-wear coating is based on chromium.

The layer 14 of the metallic material is thus a Cr layer. The layer of the metal alloy material is a CrNi layer. The layer 16 of the graded metal-ceramic material is a $CrAlN_{1-x}$ layer. The layer 17 of the ceramic material is a CrAlN layer.

FIG. 2 shows a second exemplary embodiment of the invention, wherein FIG. 2 again shows a schematic cross section through a component to the surface 21 of which is applied an anti-wear coating comprising several multilayer systems 22, 23, 24. In the exemplary embodiment in FIG. 2, each multilayer system 22, 23 and 24 comprises a layer 25 of a metallic material, a layer 26 of a graded metal-ceramic material and a layer 27 of a ceramic material. A mono-nanostructured diffusion barrier layer 28, which is provided between the multilayer system 22 and the component surface 21, is embodied here as a ceramic layer based on chromium, namely a CrN material here.

Figure 2:
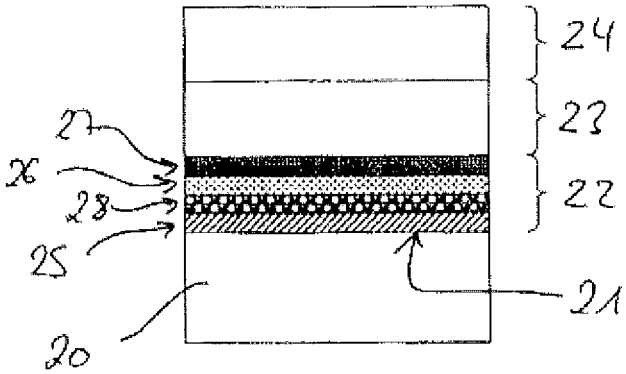
FIG. 2 shows a highly schematic cross section through an inventive anti-wear coating according to a second exemplary embodiment of the invention.

Again in the exemplary embodiment in FIG. 2, the component 20 is made of a nickel-based alloy, a cobalt-based alloy, an iron-based alloy or a titanium-based alloy. Each layer 25, 26, 27 of each multilayer system 22, 23, 24 of the inventive anti-wear coating is based on chromium. The layer 25 of the metallic material is a Cr layer. The layer 26 of the graded metal-ceramic material is a $CrAlN_{1-x}$, layer. The layer 27 of the ceramic material is a CrAlN layer.

According to an advantageous further embodiment of the present invention here, the layer 14 and/or the layer 25 of the metallic material comprise(s) at least one phase-stabilizing element, which may be tungsten (W) and/or tantalum (Ta) and/or niobium (Nb) and/or molybdenum (Mo).

Additionally or alternatively, the layers 16, 26 of the graded metal-ceramic material and the layers 17, 27 of the ceramic material may comprise or be formed from phase-stabilizing elements, such that these phase-stabilizing elements are silicon (Si) and/or titanium (Ti) and/or tantalum (Ta) and/or vanadium (V) and/or molybdenum (Mo) and/or yttrium (Y) and/or tungsten (W).

The inventive anti-wear coating thus comprises at least one multilayer system, such that each multilayer system comprises at least one metallic layer, at least one layer of a graded metal-ceramic material and at least one ceramic layer. A diffusion barrier layer is provided between the multilayer system and the surface of the component.

All the layers of the/each multilayer system are based on chromium; the diffusion barrier layer is advantageously mono-nanostructured and is formed from a ceramic CrN material. The coated component is preferably a gas turbine component of a nickel-based alloy material or a cobalt-based alloy material, an iron-based alloy material or a titanium-based alloy material.

In the embodiments of the present invention described here, the diffusion barrier layer 18, 28 is provided exclusively between the component surface and the first applied multilayer system 12, 22. For further stabilization of the overall system, additional diffusion barrier layers may of course be provided between individual multilayer systems 12, 13, 22, 23, 24 and additional diffusion barrier layers may also be provided between individual layers 14, 15, 16, 17, 25, 26, 27. These diffusion barrier layers are advantageously mono-nanostructured and are made of a CrN material.

The invention claimed is:

1. An anti-wear coating, comprising:

a multilayer system applied to a surface, wherein the multilayer system has a layer of a metallic material, wherein the layer of the metallic material is a Cr layer, a layer of a metal alloy material, wherein the layer of the metal alloy material is a CrNi layer, a layer of a graded metal-ceramic material, wherein the layer of the graded metal-ceramic material is a $CrAlN_{1-x}$ layer, and a layer of a ceramic material, wherein the layer of the ceramic material is a CrAlN layer, and wherein a diffusion barrier layer is disposed between the surface and the multilayer system;

and wherein the Cr layer also includes at least one element selected from the group consisting of tungsten and tantalum and niobium and molybdenum.

2. The anti-wear coating according to claim 1, further comprising a second multilayer system applied to the multilayer system, wherein the second multilayer system has a layer of a metallic material, a layer of a graded metal-ceramic material, and a layer of a ceramic material.

3. The anti-wear coating according to claim 2, further comprising a second diffusion barrier layer applied between the multilayer system and the second multilayer system.

4. The anti-wear coating according to claim 3, wherein the second diffusion barrier layer is a mono-nanostructured CrN layer.

5. The anti-wear coating according to claim 1, wherein the layer of the graded metal-ceramic material and/or the layer of the ceramic material also includes at least one element selected from the group consisting of silicon, tantalum, titanium, tungsten, molybdenum, yttrium and vanadium.

6. The anti-wear coating according to claim 1, further comprising a second diffusion barrier layer applied between the layers of the multilayer system.

7. The anti-wear coating according to claim 6, wherein the second diffusion barrier layer is a mono-nanostructured CrN layer.

8. A component having an anti-wear coating, wherein the anti-wear coating is embodied according to claim 1.

9. The component according to claim 8, wherein the component is formed from a nickel-based alloy, a cobalt-based alloy, an iron-based alloy, or a titanium-based alloy.

10. The anti-wear coating according to claim 1, wherein the diffusion barrier layer is a mono-nanostructured CrN layer.

* * * * *